US008875557B2

(12) United States Patent
Chian et al.

(10) Patent No.: US 8,875,557 B2
(45) Date of Patent: Nov. 4, 2014

(54) CIRCUIT DIAGNOSTICS FROM FLAME SENSING AC COMPONENT

(75) Inventors: Brent Chian, Plymouth, MN (US); Timothy J. Nordberg, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 2761 days.

(21) Appl. No.: 11/276,129

(22) Filed: Feb. 15, 2006

(65) Prior Publication Data

US 2007/0188971 A1 Aug. 16, 2007

(51) Int. Cl.
*F23Q 3/00* (2006.01)
*F23N 5/24* (2006.01)

(52) U.S. Cl.
CPC ..... *F23N 5/242* (2013.01); *F23N 2029/12* (2013.01); *F23N 2029/06* (2013.01); *F23N 2027/16* (2013.01)
USPC ..... 73/1.01; 361/247

(58) Field of Classification Search
USPC ..... 73/1.01
See application file for complete search history.

(56) References Cited

U.S. PATENT DOCUMENTS

| | | | | |
|---|---|---|---|---|
| 3,425,780 | A | 2/1969 | Potts | |
| 3,520,645 | A | 7/1970 | Cotton et al. | |
| 3,649,156 | A | 3/1972 | Conner | |
| 3,681,001 | A | 8/1972 | Potts | |
| 3,836,857 | A | 9/1974 | Ikegami et al. | |
| 3,909,816 | A | 9/1975 | Teeters | |
| 4,157,506 | A | 6/1979 | Spencer | |
| 4,221,557 | A | 9/1980 | Jalics | |
| 4,242,079 | A | 12/1980 | Matthews | |
| 4,269,589 | A | 5/1981 | Matthews | |
| 4,280,184 | A | 7/1981 | Weiner et al. | |
| 4,303,385 | A | 12/1981 | Rudich, Jr. et al. | |
| 4,370,557 | A | 1/1983 | Axmark et al. | |
| 4,450,499 | A | 5/1984 | Sorelle | |
| 4,457,692 | A | 7/1984 | Erdman | |
| 4,483,672 | A | 11/1984 | Wallace et al. | |
| 4,521,825 | A | 6/1985 | Crawford | |
| 4,527,247 | A | 7/1985 | Kaiser et al. | |
| 4,555,800 | A | 11/1985 | Nishikawa et al. | |
| 4,626,193 | A * | 12/1986 | Gann | 431/71 |

(Continued)

FOREIGN PATENT DOCUMENTS

| | | |
|---|---|---|
| EP | 0967440 | 12/1999 |
| EP | 1148298 | 10/2001 |
| WO | 9718417 | 5/1997 |

OTHER PUBLICATIONS www.playhookey.com, "Series LC Circuits," 5 pages, printed Jun. 15, 2007.

(Continued)

*Primary Examiner* — Hezron E Williams
*Assistant Examiner* — Gregory J Redmann
(74) *Attorney, Agent, or Firm* — Seager Tufte & Wickhem LLC.

(57) ABSTRACT

A diagnostic flame sensing circuit having less filtration so that an AC component of a flame sensing input is available for circuit diagnostics. Synchronized data sampling may used to detect the peak to peak magnitude of the residual AC component. A comparison of the magnitude of the component relative to a magnitude of the component during normal operation of the circuit may be used to check the condition of nearly all of the elements in the circuit.

11 Claims, 5 Drawing Sheets

(56) References Cited

U.S. PATENT DOCUMENTS

| | | | |
|---|---|---|---|
| 4,655,705 | A | 4/1987 | Shute et al. |
| 4,672,324 | A | 6/1987 | van Kampen |
| 4,695,246 | A | 9/1987 | Beilfuss et al. |
| 4,709,155 | A | 11/1987 | Yamaguchi et al. |
| 4,777,607 | A | 10/1988 | Maury et al. |
| 4,830,601 | A | 5/1989 | Dahlander et al. |
| 4,842,510 | A | 6/1989 | Grunden et al. |
| 4,843,084 | A | 6/1989 | Parker et al. |
| 4,872,828 | A | 10/1989 | Mierzwinski |
| 4,904,986 | A | 2/1990 | Pinckaers |
| 4,949,355 | A | 8/1990 | Dyke et al. |
| 4,955,806 | A | 9/1990 | Grunden et al. |
| 5,026,270 | A | 6/1991 | Adams et al. |
| 5,026,272 | A | 6/1991 | Takahashi et al. |
| 5,037,291 | A | 8/1991 | Clark |
| 5,073,769 | A | 12/1991 | Kompelien |
| 5,077,550 | A | 12/1991 | Cormier |
| 5,112,217 | A | 5/1992 | Ripka et al. |
| 5,126,721 | A | 6/1992 | Butcher et al. |
| 5,158,447 | A | 10/1992 | Geary |
| 5,175,439 | A | 12/1992 | Harer et al. |
| 5,222,888 | A | 6/1993 | Jones et al. |
| 5,236,328 | A | 8/1993 | Tate et al. |
| 5,255,179 | A | 10/1993 | Zekan et al. |
| 5,276,630 | A | 1/1994 | Baldwin et al. |
| 5,280,802 | A | 1/1994 | Comuzie, Jr. |
| 5,300,836 | A | 4/1994 | Cha |
| 5,347,982 | A | 9/1994 | Binzer et al. |
| 5,365,223 | A | 11/1994 | Sigafus |
| 5,391,074 | A | 2/1995 | Meeker |
| 5,424,554 | A | 6/1995 | Marran et al. |
| 5,446,677 | A | 8/1995 | Jensen et al. |
| 5,472,336 | A | 12/1995 | Adams et al. |
| 5,506,569 | A | 4/1996 | Rowlette |
| 5,567,143 | A | 10/1996 | Servidio |
| 5,599,180 | A | 2/1997 | Peters et al. |
| 5,682,329 | A | 10/1997 | Seem et al. |
| 5,722,823 | A | 3/1998 | Hodgkiss |
| 5,797,358 | A | 8/1998 | Brandt et al. |
| 5,971,745 | A | 10/1999 | Bassett et al. |
| 6,060,719 | A | 5/2000 | DiTucci et al. |
| 6,071,114 | A | 6/2000 | Cusack et al. |
| 6,084,518 | A | 7/2000 | Jamieson |
| 6,222,719 | B1 | 4/2001 | Kadah |
| 6,261,086 | B1 | 7/2001 | Fu |
| 6,299,433 | B1 | 10/2001 | Gauba et al. |
| 6,346,712 | B1 | 2/2002 | Popovic et al. |
| 6,349,156 | B1 | 2/2002 | O'Brien et al. |
| 6,356,827 | B1 | 3/2002 | Davis et al. |
| 6,385,510 | B1 | 5/2002 | Hoog et al. |
| 6,457,692 | B1 | 10/2002 | Gohl, Jr. |
| 6,474,979 | B1 | 11/2002 | Rippelmeyer |
| 6,486,486 | B1 | 11/2002 | Haupenthal |
| 6,509,838 | B1 | 1/2003 | Payne et al. |
| 6,552,865 | B2 | 4/2003 | Cyrusian |
| 6,676,404 | B2 | 1/2004 | Lochschmied |
| 6,743,010 | B2 | 6/2004 | Bridgeman et al. |
| 6,782,345 | B1 | 8/2004 | Siegel et al. |
| 6,794,771 | B2 | 9/2004 | Orloff |
| 6,912,671 | B2 | 6/2005 | Christensen et al. |
| 6,917,888 | B2 | 7/2005 | Logvinov et al. |
| 7,088,137 | B2 | 8/2006 | Behrendt et al. |
| 7,088,253 | B2 | 8/2006 | Grow |
| 7,202,794 | B2 | 4/2007 | Huseynov et al. |
| 7,241,135 | B2 | 7/2007 | Munsterhuis et al. |
| 7,255,285 | B2 | 8/2007 | Troost et al. |
| 7,274,973 | B2 | 9/2007 | Nichols et al. |
| 7,289,032 | B2 | 10/2007 | Seguin et al. |
| 7,327,269 | B2 | 2/2008 | Kiarostami |
| 7,617,691 | B2 | 11/2009 | Street et al. |
| 7,728,736 | B2 | 6/2010 | Leeland et al. |
| 7,764,182 | B2 | 7/2010 | Chian et al. |
| 7,768,410 | B2 | 8/2010 | Chian |
| 7,800,508 | B2 | 9/2010 | Chian et al. |
| 2002/0099474 | A1 | 7/2002 | Khesin |
| 2003/0064335 | A1 | 4/2003 | Canon |
| 2003/0222982 | A1 | 12/2003 | Hamdan et al. |
| 2004/0209209 | A1 | 10/2004 | Chodacki et al. |
| 2005/0086341 | A1 | 4/2005 | Enga et al. |
| 2006/0257804 | A1* | 11/2006 | Chian et al. ..... 431/24 |
| 2006/0257805 | A1 | 11/2006 | Nordberg et al. |
| 2007/0159978 | A1 | 7/2007 | Anglin et al. |
| 2009/0009344 | A1 | 1/2009 | Chian |
| 2009/0136883 | A1 | 5/2009 | Chian et al. |
| 2010/0013644 | A1 | 1/2010 | McDonald et al. |
| 2010/0265075 | A1 | 10/2010 | Chian |

OTHER PUBLICATIONS

Honeywell, "S4965 Series Combined Valve and Boiler Control Systems," 16 pages, prior to the filing date of present application.

Honeywell, "SV9410/SV9420; SV9510/SV9520; SV9610/SV9620 SmartValve System Controls," Installation Instructions, 16 pages, 2003.

* cited by examiner

CIRCUIT DIAGNOSTICS FROM FLAME SENSING AC COMPONENT

BACKGROUND

This invention pertains to combustion systems, and particularly to sensors of the systems. More particularly, the invention pertains to flame sensors.

This invention is related to U.S. patent application Ser. No. 10/908,463, filed May 12, 2005; U.S. patent application Ser. No. 10/908,465, filed May 12, 2005; U.S. patent application Ser. No. 10/908,466, filed May 12, 2005; and U.S. patent application Ser. No. 10/908,467, filed May 12, 2005.

U.S. patent application Ser. No. 10/908,463, filed May 12, 2005; U.S. patent application Ser. No. 10/908,465, filed May 12, 2005; U.S. patent application Ser. No. 10/908,466, filed May 12, 2005; and U.S. patent application Ser. No. 10/908, 467, filed May 12, 2005; are hereby incorporated by reference.

SUMMARY

This invention is a circuit and an approach for providing circuit and component diagnostics from a flame sensing AC component.

DESCRIPTION

A flame sensing circuit in a residential combustion system such as a furnace may use a high voltage AC to sense a flame. As the flame sensing is a critical safety function, it is important to check the integrity of the circuit to assure that the flame sensing is accurate and reliable during the furnace run time.

The present invention may make use of the residual AC component at the flame sensing input to check whether the flame sensing system is in good working condition.

The present system may use less filtration than a conventional sensing system so that the AC component of the flame excitation signal may readily exist at an input of an analog-to-digital converter (ADC) for a combustion system controller or the like. A significant AC component may be rather easily used to diagnose the circuit of the system. The amplitude and other properties of the AC component may be used to diagnose the system and check the condition of the parts or portions of the flame sensing circuit.

A synchronized data sampling with, for example an ADC, may be used to sense the peak-to-peak voltage of the AC component. With the circuit parts or portions in good working condition, the AC component amplitude may be estimated or measured. These amplitude data may be stored in a non-volatile memory of the controller. During normal operation, the AC component may be continuously monitored. If the component becomes too high or too low compared to the stored value, an error message may be reported. The AC component amplitude may be used to scope in on the possibly faulty part or portion of the circuit.

Figure 1:
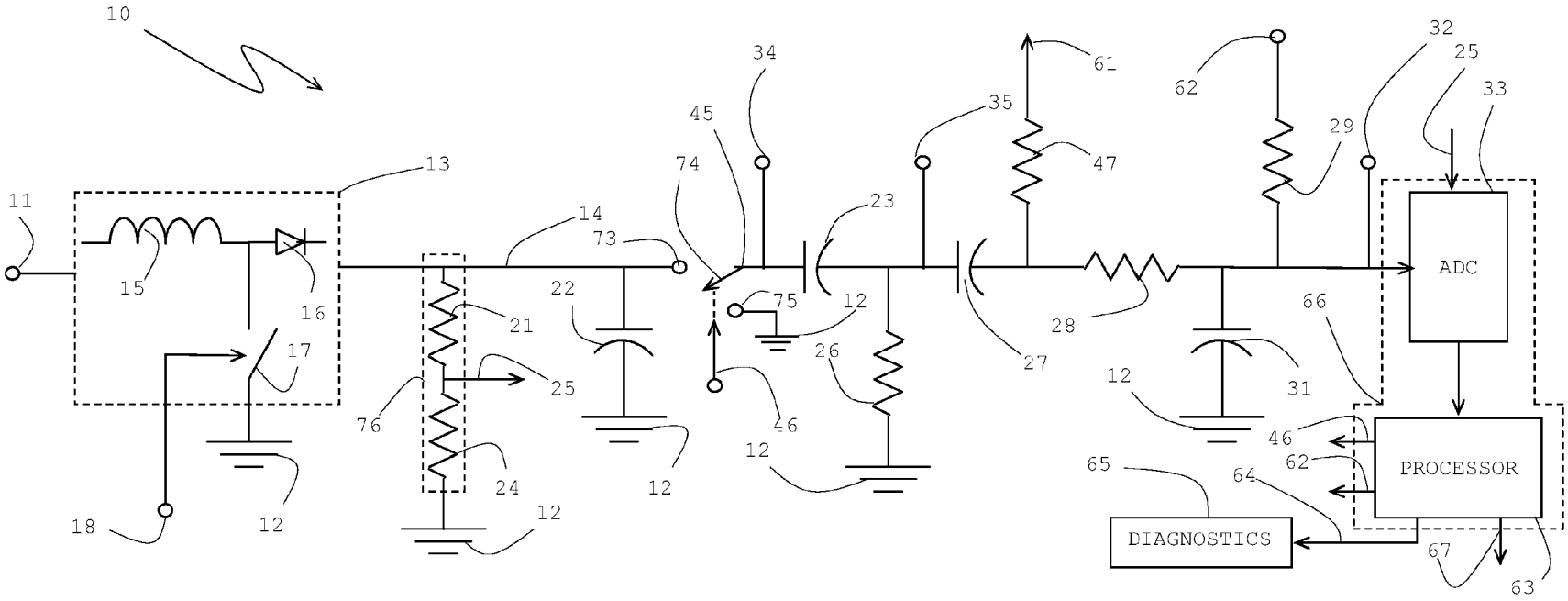
FIG. 1 is a schematic of a flame sensing circuit designed to provide its own diagnostics.

FIG. 1 shows a diagram of a circuit 10 for the invention. Variants of the circuit design may be implemented including various component values. For this illustrative example, a positive DC voltage of about 25 to 42 volts may be applied to an input 11 relative to a ground 12. The input 11 may be connected to a circuit 13 which is DC to DC step-up converter to about 140 to 300 volts at a line or point 14. However, the input to terminal 11 may be as low as a few volts or it may be as high as several hundred volts. Circuit 13 may be optional if the input voltage is sufficiently high enough (i.e., hundreds of volts).

Assuming an incorporation of circuit 13, in the present illustrative example, an inductor 15 may have one end connected to an anode of a diode 16 and to one end of a chopper switch 17. The other end of switch 17 may be connected to a reference ground 12. A terminal 18, connected so as to operate chopper switch 17, may be connected to a pulse width modulator having a frequency of about 32 kHz.

An output 14 of circuit 13 or other voltage or electrical power source may be connected to one end of a resistor 21, a capacitor 22 and to an input (throw) terminal 73 of a chopper switch 45. Chopper switch or chopper 45 may be a single-pole 74, double-throw type. The other throw terminal 75 may be connected to the reference ground 12. The other end of resistor 21 may be connected to one end of resistor 24. This middle terminal or connection 25 may provide a voltage for one input of ADC 33. The other end of resistor 24 may be connected to ground 12. Resistors 21 and 24 may form a voltage divider 76 for the middle connection 25 between the voltage potential on line 14 and the reference ground 12. Resistors 21 and 24 along with connection 25 of voltage sensing circuit 76 to ADC 33 may be an illustrative example of a voltage sensor. Other examples of voltage sensors may be used, or the voltage sensor may be optional in circuit 10. Voltage divider 76 and capacitor 22 may be used with a DC-DC voltage converter or when the high DC voltage source is not stable.

The other end, lead, electrode or side of capacitor 22 may be connected to ground 12. The other end of chopper 45 may be connected to one end of a capacitor 23. The other end of capacitor 23 may be connected to one end of a resistor 26 and one end of capacitor 27. Capacitor 23 and resistor 26 may be optional components. Filtration resulting from those components might not be needed or desired.

Chopper 45 may be operated with a 2.4 KHz square wave signal at a drive terminal or input 46. Other signals may be resorted to for chopper 45. Equivalent substitutes of the chopper may be used instead.

In operation, chopper 45 may switch back and forth with an output from a switchable or changeable terminal between line 14 and ground 12 at a rate as indicated by a signal at input 46. The other end of resistor 26 may be connected to ground 12. The other end of capacitor 27 may be connected to one end of resistor 47 and one end of resistor 28. The other end of resistor 47 at point 61 may be connected to a sensing rod of the flame sensing circuit 10. The other end of resistor 28 may be connected to one end of a resistor 29, one end of a capacitor 31, and a terminal 32. Instead of resistor 29 connected to a PWM source, other kinds of bias voltage control may be used, e.g., a voltage divider circuit.

The other end of resistor 29 at point 62 may be connected a 32 KHz pulse width modulator (PWM). A duty cycle of this PWM may be used to adjust a bias voltage on line or terminal 32. The other end of capacitor 31 may be connected to ground 12. The terminal 32 may be connected to a second input of an ADC 33. An output of ADC 33 may go to a processor 63. Processor 63 may process ripple voltage information into diagnostic information which may be provided on an output 64 which may be indicated to an observer or user by a diagnostics block 65. Diagnostics block 65 may be optional. The controller 66 may simply stop normal operation of an associated or controller appliance, or the like, without indicating a flame error condition. ADC 33 and processor 63 may be a part of a controller 66. An output 67 may be part of a furnace, or other appliance, control.

The components may have various values. The values stated here may be one set of reasonable instances of them; although other values might be used. Resistor 21 may be 470 k-ohms; resistor 24 may be 12 k-ohms; resistor 26 may be 100 k-ohms; resistor 47 may be 480 k-ohms; resistor 28 may be 590 k-ohms; and resistor 29 may be about 232 k-ohms. Capacitor 22 may be 0.01 microfarad; capacitor 23 may be 0.01 microfarad; capacitor 27 may be 0.0022 microfarad; and capacitor 31 may be 0.1 microfarad.

Figure 2A:
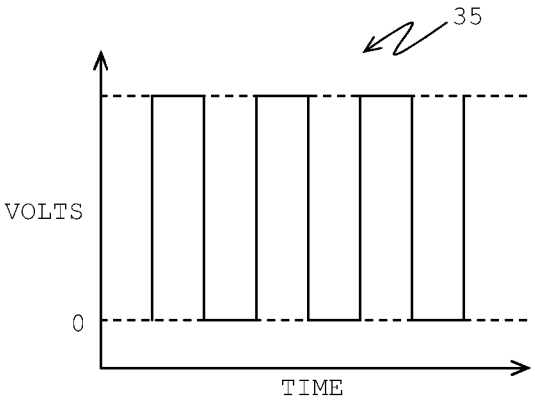
FIGS. 2*a* and 2*b* show waveforms at certain points of the flame sensing circuit.
Figure 2B:
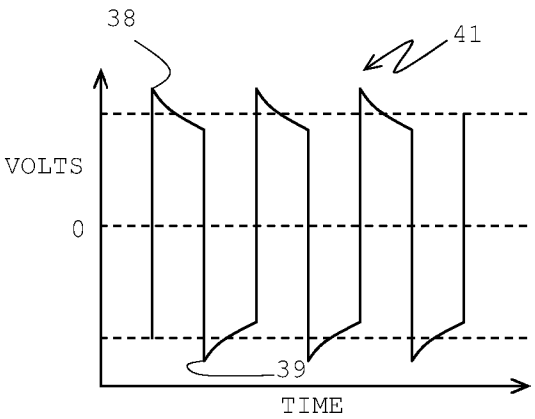

At point or terminal 34 may be a square wave 35 (shown in FIG. 2*a*) having a peak to peak value from about zero volts to a voltage between about 140 and 300 volts. At point 35 may be a distorted square wave 41 (shown in FIG. 2*b*) with a slight decay at the peaks 38 and 39, having a peak to peak voltage from between about −80 and −160 volts to between about +80 and +160 volts.

Figure 3:
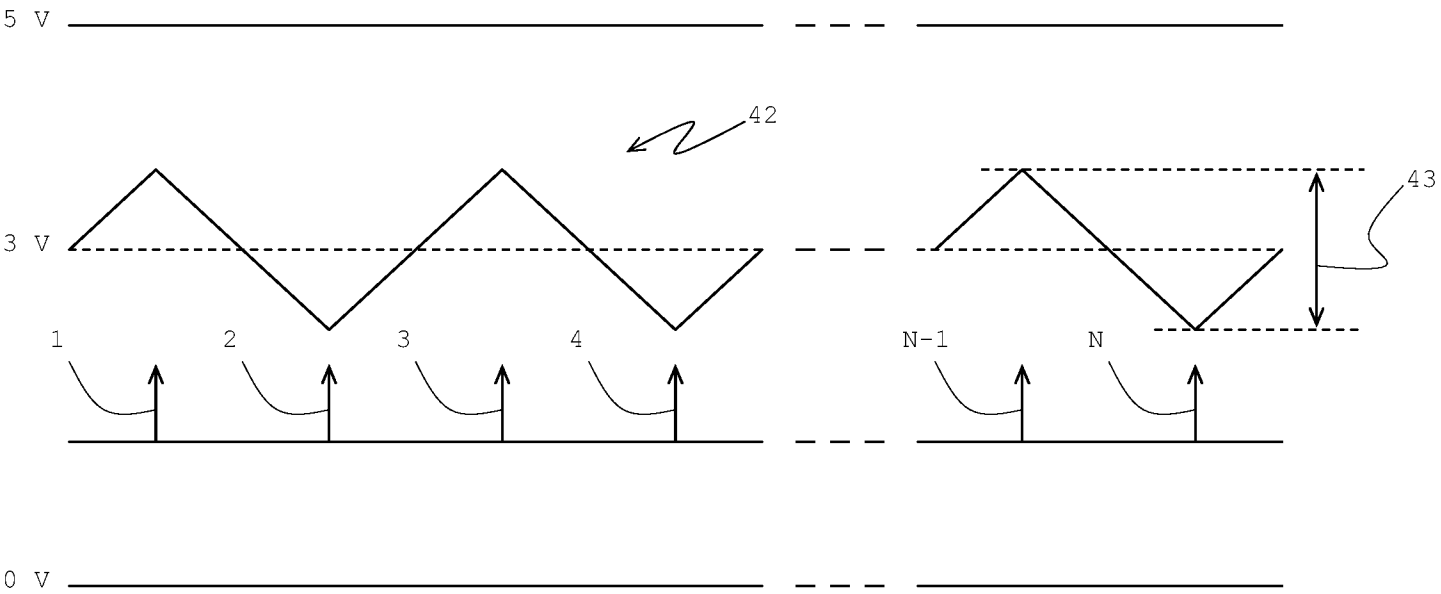
FIG. 3 shows a ripple waveform at an output of the circuit that may provide diagnostic information.

FIG. 3 shows a signal 42 to one input of ADC 33. The input range of the ADC 33 may be between about zero and five volts. At 300 volts on point 14, the AC ripple 43 under normal operating conditions should be about 540 millivolts peak to peak on a three volt DC level. The ADC 33 measurement may be timed so as to be at the peaks of the AC ripple signal 43, as shown by timing marks 1, 2, 3, 4, . . . , N−1, N. The mean ripple may be calculated as $$\left(\sum_{N} \text{1-2, 3-4, } \ldots \text{, } (N-1)-N\right) \Big/ (0.5 * N) = \text{normal ripple peak to peak } (V_{norm}).$$

The normal peak to peak ripple may be about 540 millivolts ($V_{norm}$) for about 300 volts peak to peak at point 14 of circuit 10.

If the voltage at line 14 is not a well regulated voltage, then the voltage may be sensed by network 76 which is connected via the connection 25 to the A/D converter 33, and the $V_{norm}$ level can be calibrated using the measured voltage at line 14.

The readings of the ripple voltage (peak to peak) signals may provide a set of diagnostic indications. When the flame sensor drive 61 is on, and if the ripple is greater than about two times the $V_{norm}$, then the cause may be any one or combination of: 1) resistor 28 has leakage; 2) resistor 29 is open; 3) capacitor 31 is smaller than normal; 4) resistor 26 is open; 5) the resistor 21 to resistor 24 ratio is incorrect (such that the DC-DC output is higher); 6) capacitor 23 and/or 27 are shorted; or 7) the PWM frequency at terminal 46 is too low.

The flame sensor drive 61 is on and if the ripple is less than about ⅜ of the $V_{norm}$, then the cause may be any one or combination of: 1) capacitor 31 has leakage; 2) resistor 26 and resistor 29 have leakage; 3) the resistor 21 to resistor 24 ratio is incorrect (such that the DC-DC output is lower); 4) the ADC 33 sensing is out of sync with the chop circuit signal at point 34; 5) the chopper has stopped; 6) the DC-DC circuit is not operating; 7) PWM frequency at terminal 46 is too high; or 8) capacitor 23 and/or capacitor 27 is open or too small.

When the flame sensor drive 61 is off and the ripple is greater than about 150 millivolts, the cause may be: 1) too much noise (i.e., the DC-DC circuit output noise is too high, e.g., capacitor 22 is much smaller than normal); or 2) the micro processor is out of control (such that the chopper should be inactive although it stays active).

Figure 4:
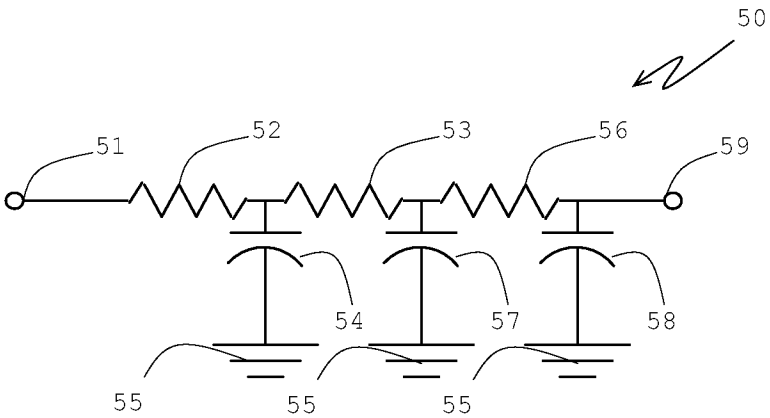
FIG. 4 is an example of a flame sensing circuit.

FIG. 4 reveals a somewhat conventional flame sensing interface circuit 50. A terminal 51 may be connected to a 60 Hz AC power line which may have a signal with about plus and minus 170 volt peaks. Terminal or line 51 may be connected to one end of a 4.7 megohm resistor 52. The other end of resistor 52 may be connected to one end of a 4.7 megohm resistor 53 and to one end of a 0.01 microfarad capacitor 54. The other end of capacitor 54 may be connected to a ground reference 55. The other end of resistor 53 may be connected to one end of a 4.7 megohm resistor 56 and to one end of a 0.01 microfarad capacitor 57. The other end of a capacitor 57 may be connected to the ground 55. The other end of resistor 56 may be connected to one end of a 0.01 microfarad capacitor 58 and to an output terminal 59. The other end of capacitor 58 may be connected to the ground 55. This circuit 50 is less advantageous than the present circuit 10. It is more sensitive to leakage and has a slower response than the circuit 10.

Figure 5:
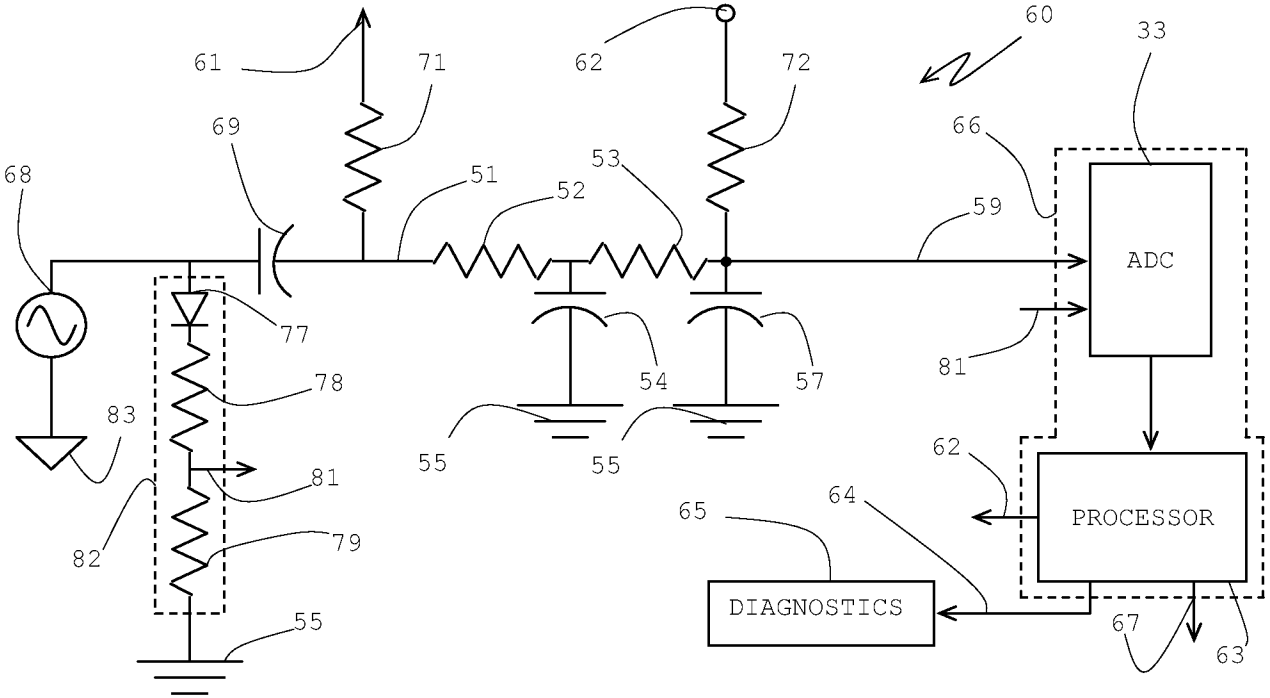
FIG. 5 shows a modification of the circuit shown in FIG. 4 for diagnostic purposes.

A modification of circuit 50, shown as a circuit 60 in FIG. 5, includes reduced filtration to obtain a ripple and gain a capability of diagnosing the integrity of the flame sensing circuit, and at the same time improve the flame sensing response time. For instance, one may remove resistor 56 and capacitor 58 of circuit 50, add a bias source through resistor 72, and adjust the values of the remaining parts so that the AC ripple at the output terminal 59 is within a range that a controller 66 can measure. The controller 66 may include an ADC 33 for receipt and A-to-D conversion of the ripple signal from output terminal 59. The converted signal may go to the processor 63 of controller 66 to monitor the ripple level and detect if any component is shorted, open, or has strong leakage. The diagnostic indications or results 64 about the circuit 60 may be provided from the processor 63 of controller 66 to a diagnostics block 65 for review by a user or an observer. The diagnostics indicator or block 65 may be optional. Controller 66 may simply stop normal operation of an associated or controlled appliance, or the like, without indicating a flame error condition.

An input signal or power to circuit 60 may come from an AC voltage source 68 relative to a ground reference 83. The input may go through a DC blocking capacitor 69 on to a line 51 which is connected to one end of the resistor 52. From line 51 may be a voltage provided via a resistor 71 to a point 61 which may be connected to a flame sensing rod or sensor. At the output line 59 may be a resistor 72 connected to a pulse width modulation (PWM) signal generator at a point 62 of the resistor. A duty cycle of the PWM signal may be varied to adjust a bias voltage of the signal on line 59 to ADC 33.

Unlike the circuit 10 shown in FIG. 1 that may have a stable flame drive, this circuit 60 may use the AC power line voltage (e.g., source 68) as a flame drive at point 61. The AC power line voltage may vary from time to time and from location to location. To establish a threshold level $V_{norm2}$ that tracks the change of the AC power line voltage, an AC voltage sensing circuit 82 may be used. A diode 77, two resistors 78 and 79 may be used as shown in FIG. 5 to form a rectified voltage divider to sense the AC voltage. The AC power source 68 may have a ground reference 83 which is not necessarily the same as the ground reference 55 of the flame sensing and control circuit 60. The AC voltage sensing network 82 shown in FIG. 5 is just one of the many possible AC voltage sensing configurations. The anode of diode 77 may be connected to source 68, and its cathode to a resistor 78, with the other end, or a connection 81, of resistor 78 connected to a resistor 79 and to an A/D input 81 of ADC 33. The other end of resistor 79 may be connected to ground 55. This sensing or control network or circuit 82 may measure the peak of the AC voltage and set the calibrated ripple normal level $V_{norm2}$. In this way, variation of the AC power line voltage source 68 should not affect the diagnostics of the flame sensing circuit. Also, this sense and control may be noticed as stopped when the AC source 68, particularly in the case of its being a power line; here, the control circuit 60 will be off since there is no control of such source.

With the AC voltage source 68 being detected as within normal operating range, and if the ripple is greater than about two times the calibrated ripple peak to peak ($V_{norm2}$) for circuit 60, then a cause may be any one or a combination of: 1) resistor 52 and/or 53 has leakage; 2) resistor 72 is open; 3) capacitor 54 and/or 57 is open or smaller than normal; or 4) capacitor 69 is shorted.

With the AC voltage source 68 being detected as within normal operating range, and if the ripple is less than about ⅜ of the $V_{norm2}$, then the cause may be any one or a combination of: 1) capacitor 54 and/or 57 has leakage; 2) ADC 33 sensing is out of synchronization with the AC source 68; 3) resistor 72 has leakage; 4) resistor 52 and/or 53 is open; or 5) capacitor 69 is open or too small.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. A diagnostic flame sensing circuit comprising:
- a chopper;
- a high voltage DC source connected to a first terminal of the chopper; and
- a filter connected to a second terminal of the chopper; and
- wherein:
  - a first output of the filter is provided to a flame sensor;
  - a second output of the filter comprises diagnostic information;
  - when the flame sensing circuit is activated, an analysis of the second output of the filter reveals a condition of one or more circuit components of the flame sensing circuit; and
  - the revealed condition of one or more circuit components of the flame sensing circuit includes one or more of:
    - a resistor having leakage;
    - a resistor being open;
    - a capacitor being smaller than normal;
    - a resistor to resistor ratio being incorrect;
    - a capacitor being shorted;
    - a frequency of a pulse width modulator being too low;
    - a capacitor having leakage;
    - the sensing timing of an analog-to-digital converter being out of sync with an output signal of the chopper;
    - the chopper having stopped;
    - a DC-DC voltage converter component not operating;
    - a frequency of a pulse width modulator being too low;
    - a capacitor being open;
    - the output of the second filter containing too much noise; and
    - a microcontroller having lost control over the chopper.

2. The circuit of claim 1, wherein an analysis of the second output of the filter reveals:
- when a ripple of the second output of the filter is greater than a normal ripple, one or more components of the flame sensing circuit are abnormal;
- when the ripple of the second output of the filter is less than the normal ripple, one or more components of the filter are abnormal; and
- when the flame sensing rod is not driven and the ripple of the second output of the filter is reasonably observable, there is significant noise at the input to the filter.

3. The circuit of claim 2, wherein when the high voltage DC source is not providing a significant voltage to the first terminal of the chopper and the ripple is above a threshold level, an analysis of the output of the second filter reveals one or more of the group consisting of:
- there is noise from the high voltage DC source,
- a filter component is abnormal, and
- the chopper is receiving a drive signal from the frequency generator.

4. The flame sensing circuit of claim 1, further comprising a processor connected to the second output of the filter, wherein the processor is configured to analyze the diagnostic information and determine the status of one or more components of the flame sensing circuit.

5. The flame sensing circuit of claim 1, wherein the diagnostic information includes a ripple.

6. The flame sensing circuit of claim 5, wherein when a flame sensing drive is on and when the ripple is greater than a first threshold amount above a normal ripple, the ripple reveals one of the group consisting of:
- a resistor having leakage;
- a resistor being open;
- a capacitor being smaller than normal;
- a resistor to resistor ratio being incorrect;
- a capacitor being shorted; and
- a frequency of a pulse width modulator being too low.

7. The flame sensing circuit of claim 6, wherein the first threshold amount greater than two times the normal ripple.

8. The flame sensing circuit of claim 5, wherein when a flame sensing drive is on and when the ripple is greater than a second threshold amount below a normal ripple, the ripple reveals one of the group consisting of:
- a capacitor having leakage;
- a resistor having leakage;
- a resistor to resistor ratio being incorrect;
- the sensing timing of an analog-to-digital converter being out of sync with an output signal of the chopper;
- the chopper having stopped;
- a DC-DC voltage converter component not operating;
- a frequency of a pulse width modulator being too low;
- a capacitor value being too small; and
- a capacitor being open.

9. The flame sensing circuit of claim 8, wherein the threshold amount is less than three-eighths of the normal ripple.

10. The flame sensing circuit of claim 5, wherein when a flame sensing drive is on and when the ripple is greater than a third threshold, the ripple reveals one of the group consisting of:
- the output of the second filter containing too much noise;
- a microcontroller having lost control over the chopper.

11. The diagnostic flame sensing circuit of claim 1, wherein:

the second output of the filter is provided to a processor;

the chopper oscillates between the high voltage DC source and ground and provides a first signal containing an AC ripple to the filter;

the second output contains an AC ripple;

the processor compares a peak-to-peak amplitude of the AC ripple to one or more thresholds; and the processor determines, based at least in part of the comparison of the peak-to-peak amplitude of the AC ripple to one or more thresholds, whether one or more components of the diagnostic flame sensing circuit are shorted, leaking, open, or smaller than normal.

* * * * *